US005193521A

United States Patent [19]

Levinson et al.

[11] Patent Number: 5,193,521

[45] Date of Patent: Mar. 16, 1993

[54] PORTABLE FUEL CANISTER

[76] Inventors: Benjamin Levinson, 7400 Radice Ct., #303, Lauderhill, Fla.; Leonard J. Scarnato, 12 Mabro Dr., Denville, N.J.

[21] Appl. No.: 836,124

[22] Filed: Feb. 14, 1992

[51] Int. Cl.[5] ..... F24C 5/04

[52] U.S. Cl. ..... 126/45; 431/320; 126/43

[58] Field of Search ..... 431/320, 325, 298; 126/43, 44, 45, 46, 49, 50; 44/540

[56] References Cited

U.S. PATENT DOCUMENTS

| | | | |
|---|---|---|---|
| 3,042,108 | 7/1962 | Boij et al. . | |
| 3,279,222 | 10/1966 | Hebard . | |
| 3,290,907 | 12/1966 | Boij et al. . | |
| 3,606,609 | 9/1971 | Lipper | 126/43 X |
| 4,624,633 | 11/1986 | Bandel . | |
| 4,850,858 | 7/1989 | Blankenship et al. | 431/320 |
| 4,896,653 | 1/1990 | Eke et al. | 431/320 X |

*Primary Examiner*—Larry Jones
*Attorney, Agent, or Firm*—Malloy, Downey & Malloy

[57] ABSTRACT

A cooking apparatus adapted to burn liquid fuel including a container defining an outer housing and having a base, a surrounding side walls structure, and top, the top having an opening therethrough in exposing relation to an interior chamber of the container wherein a fiberglass material is disposed in substantially filling relation and is structured to hold and regulate the movement of liquid fuel therein so as to prevent spillage of the liquid fuel from within the container, the liquid fuel being delivered to an upper exposed surface of the fiberglass material adjacent to the opening of the top by a braided fiberglass ignitor cord, which further facilitates igniting and provides for the continuous burning of the fuel at the upper exposed surface, and the fiberglass material being contained within the interior chamber by a retainer screen disposed in covering relation over the opening in the top of the container.

10 Claims, 1 Drawing Sheet

PORTABLE FUEL CANISTER

BACKGROUND OF THE INVENTION

1. Field of the Invention

This invention relates to a cooking apparatus, adapted to burn liquid fuel, having a fiberglass material to hold and contain the fuel, and providing for burning at an upper exposed surface thereof, thereby providing a cooking apparatus which is safe as it is not susceptible to spillage of the liquid fuel, and will provide a large burn area so as to enable the cooking apparatus to attain the higher temperatures necessary for cooking.

2. Description of the Related Art

Portable fuel canisters are a commonly used means for providing heat, especially as required to maintain items, such as food, hot, yet readily accessible. These types of burners are popularly used in buffet type situations, wherein food contained in serving pans is sought to be kept hot. Further, it is often desirous to cook various food items using these portable burners, such as during camping, fishing or other outdoor activities. As a result of these common and beneficial uses, there have been numerous designs of burners which attempt to optimize their convenience. Examples of these portable burners include, U.S. Pat. No. 4,725,225 to Grabitt, U.S. Pat. No. 3,042,108 to K.O.A. Boij et al., U.S. Pat. No. 3,290,907 to K.O.A. Boij et al., U.S. Pat. No. 4,624,633 to Bandel, and U.S. Pat. No. 3,516,774 to G.W. Livingston. Unfortunately, all of these designs heat by means of a wick which draws fuel from a reservoir. While having some advantages, a wick type burner provides limited heat which is generally useful for warming and insufficient to cook food. Further, a liquid fuel is absorbed into the wick and flows quite readily from a reservoir, presenting a highly dangerous situation should the burner tip and the fuel spill, as the flame will ignite the spilled fuel and cause a substantial fire. In addition to wick type burners, other inventions have attempted to maintain a larger burning surface in order to maximize the heating capacity. Examples of such designs include U.S. Pat. No. 4,850,858 to Blankenship et al., and the commonly known "STERNO" ® burners. These devices however, also utilize fuel that is prone to spilling from the canister should the burner fall. More particularly, the STERNO ® type burners use a gel alcohol fuel which melts as it burns thereby allowing it to splash or spill should the canister be accidentally tipped or abruptly moved. Additionally, the fuel in these devices burns down, thereby making the burn area difficult to ignite after its initial use and making the container very hot due to the flame being within the canister. As the fuel burns down, the level of the flames gradually lowers in accordance with the fuel level in the canister. Thus, the effectiveness of the burner is reduced as it burns due to the flame level moving down and away from the item being heated. Additionally, the "STERNO" ® type burners are subject to flash igniting which is potentially dangerous to a user who must relight or initially light the burner. Further, most of these burners in the related art employ metal lids which can cause the fuel to evaporate, and are constructed such that the containers are subject to rust and corrosion. Finally, these types of known burners, are often malodorous, emit toxic gasses, and unpredictably burn when almost out of fuel. For these reasons, it is highly desirous to have a new cooking burner which will be as equally convenient as known burners, but will greatly reduce the potential dangers involved.

The present invention is specifically designed to overcome the shortcomings of the prior art. The cooking fuel canister is non-toxic and includes a container that will not be subject to rust or corrosion, thereby increasing the shelf life of the product. Further, the present invention provides an extensive burn surface which will provide the higher temperatures necessary for cooking to be attained, and the flame level does not burn down such that the heating temperature will remain constant Additionally, the fuel canister of the present invention provides for a slow igniting of the burn surface, thereby making it safe to light and relight. Finally, Applicant's invention utilizes odorless and clean burning fuel which is contained so as to be spillproof, yet burn at an upper surface, thereby maximizing the fuel efficiency of the burner and maintaining the cool container relatively cool and manageable.

SUMMARY OF THE INVENTION

The present invention is directed towards a cooking apparatus adapted to burn liquid fuel. The cooking apparatus includes primarily a container defining an outer housing. The container includes a base, a surrounding side wall structure, and a top, the top including an opening therethrough in exposing relation to an interior chamber of the container. Disposed in substantially filling relation within the interior chamber are fuel containing means. The fuel containing means are structured to hold and regulate the movement of the liquid fuel therein so as to prevent spillage of the liquid fuel from within the container. Further included within the container are fuel delivery means for delivering the liquid fuel to an upper exposed surface of the fuel containing means adjacent to the opening of the top. The fuel delivery means are disposed to facilitate igniting of the upper exposed surface, and are structured to facilitate the subsequent continuous burning of the fuel at the upper exposed surface. Finally, the container includes means to maintain the fuel containing means within the interior chamber.

The object to the present invention is to provide a cooking apparatus which will provide a large burn area enabling it to attain the higher temperatures necessary for cooking and not merely warming.

Another object of the present invention is to provide a means of utilizing liquid fuel in cooking while maintaining the liquid fuel safely contained and secured from spillage.

Yet another object of the present invention is to provide facilitated means of igniting the cooking apparatus which will provide for a gradual igniting of the entire burn area, thereby preventing rapid and often dangerous igniting of the burn area.

Still another object of the present invention is to provide a safe means of burning liquid fuel, while utilizing substantially all of the liquid fuel contained.

A further object of the present invention is to provide a cooking apparatus in which burning is at an upper exposed surface alone, thereby making the lower portions of the container handleable.

Another object of the present invention is to provide a means of easily resealing the container and preventing evaporation of the fuel contained therein.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
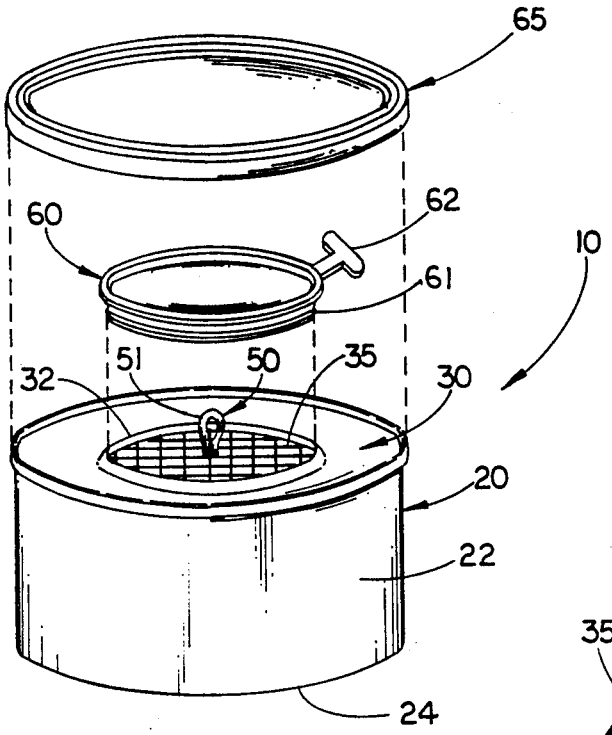
FIG. 1 is a perspective view of the cooking apparatus.
Figure 3:
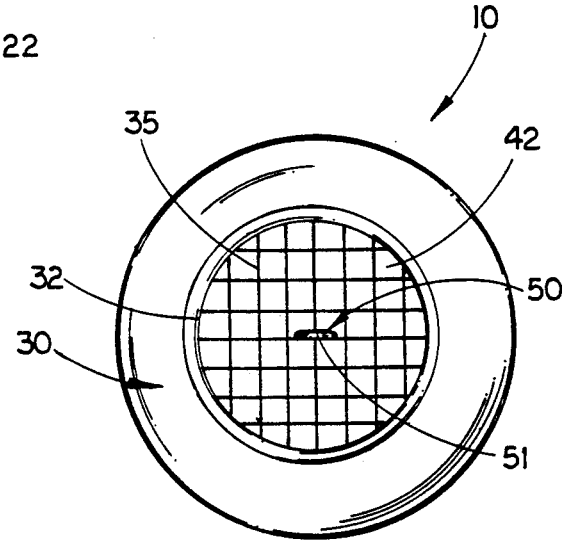
FIG. 3 is a top view of the cooking apparatus.
Figure 2:
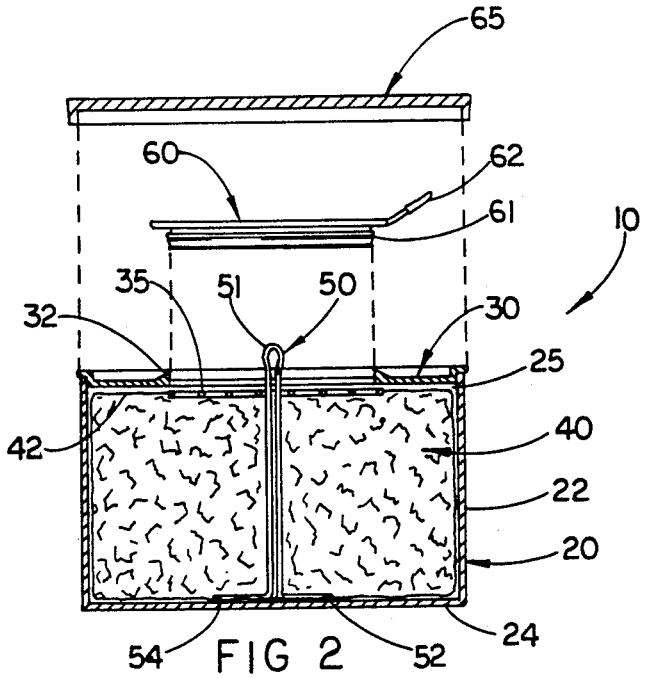
FIG. 2 is a cross-sectional view of the cooking apparatus.

As shown throughout FIGS. 1-3, the present invention is directed towards a portable, disposable cooking apparatus structured and disposed to provide a continuous cooking and heating flame for more than four hours, and be safe from spillage of liquid fuel used therein.

Referring to FIG. 1, the cooking apparatus 10 primarily includes a container 20 having a surrounding side wall structure 22 and base 24, which are integrally formed with one another, and a top 30. The container 20 is of an integral, seamless steel construction and includes a corrosive-proof exterior coating to provide the cooking apparatus 10 with an extended shelf life. The container 20 defines an interior chamber 25, best seen in FIG. 2, which contains a fiberglass material 40 in substantially filling relation therein which is structured to hold and regulate the movement of liquid fuels contained therein so as to prevent spillage of the liquid fuel from within the container 20.

Referring to FIGS. 2 and 3, the top 30 of the container 20 includes a concentrically positioned opening 32. The concentrically positioned opening 32 is structured so as to define an upper exposed surface 42 of the fiberglass material 40 contained within the interior chamber 25. In order to maintain the fiberglass material 40 securely within the interior chamber 25 of the container 20, a retainer screen 35 extends substantially across the opening 32 in the top 30. Extending centrally through the fiberglass material 40 is a braided fiberglass ignitor cord 50. The ignitor 50 includes opposite distal ends 52 and 54 positioned adjacent the base 24 within the interior chamber 25, and includes a central portion 51 which protrudes through the retainer screen 35 and out of the opening in the top 30, thereby forming a loop which will remain protruding and facilitate igniting thereof. The ignitor cord 50 is structured and disposed to deliver liquid fuel from the interior chamber 25 to the looped central portion 51 and to the upper exposed surface 42 of the fiberglass material 40 through capillary action. Further, when the central loop 51 of the ignitor cord 50 is ignited, it will result in the igniting of the liquid fuel at the upper exposed surface 42 of the fiberglass material 40. As a result of this burning process, all liquid fuel will be burned at the upper exposed surface 42 of the fiberglass material 40, thereby providing a large burn area capable of providing the higher temperatures necessary for cooking, and maintaining the surrounding side wall structure 22 of the container 20 relatively cool and handleable.

Finally, as best seen in FIGS. 1 and 2, the fuel cooking apparatus 10 includes a plastic or like material seal cap 60 and a plastic or like material container lid 65. The seal cap 60 is structured so as to be securely fitted within the opening 32 in the top 30 of the container 20, thereby preventing the evaporation of the liquid fuel within the interior chamber 25 of the container 20. In order to assure a tight seal within the opening 32 of the top 30, the sealed cap 60 includes a protruding ridge 61 extending about the periphery thereof, thereby providing a snap-fit of the seal cap 60 within the opening 32. In order to facilitate quick and easy removal of the seal cap 60, and to enable the seal cap 60 to be reusable, the seal cap 60 includes a protruding pull tab integrally formed therewith. Positionable over the top 30 of the container 20, is the container lid 65 which will further seals in the contents of the container 20, and may include indicia on an outer exposed surface thereof.

Now that the invention has been described, what is claimed is:

1. A cooking apparatus adapted to burn liquid fuel comprising:

a container defining an outer housing and including a base, a surrounding side wall structure, and a top, said top including an opening therethrough in exposing relation to an interior chamber of said container, fuel containing means disposed in substantially filling relation within said interior chamber and being structured to hold and regulate the movement of the liquid fuel therein so as to prevent spillage of the liquid fuel from within the container, fuel delivery means for delivering the liquid fuel to an upper exposed surface of the fuel containing means adjacent to said opening of said top, and disposed to facilitate igniting and subsequent continuous burning of the fuel at said upper exposed surface, and means to maintain said fuel containing means within said interior chamber.

2. An apparatus as recited in claim 1 wherein said side wall structure of said container is cylindrical and said top and base are substantially circular in configuration.

3. An apparatus as recited in claim 2 wherein said opening is centrally disposed in said top and is substantially circular, having a diameter of at least one inch.

4. An apparatus as recited in claim 3 wherein said fuel containing means includes a fiberglass material.

5. An apparatus as recited in claim 4 wherein said means to maintain said fuel containing means within said interior chamber includes a retainer screen extending substantially across said opening in said top of said container so as to maintain said fiberglass material secured in said interior chamber of said container.

6. An apparatus as recited in claim 5 wherein said fuel delivery means includes a braided fiberglass ignitor cord having opposite distal ends thereof positioned substantially adjacent said base within said interior chamber of said container and having a central portion thereof extending through said fuel containing means and said opening in said top of said container, so as to include a protruding loop outside of said container being structured and disposed to facilitate igniting thereof.

7. An apparatus as recited in claim 6 wherein said ignitor cord is structured and disposed to deliver fuel from said interior chamber to said protruding loop and said upper exposed surface through capillary action.

8. An apparatus as recited in claim 7 including a plastic or like material seal cap, said seal cap being structured and disposed to substantially cover said opening in said top of said container, and including a protruding pull tab for facilitated removal thereof, and a protruding ridge about the periphery thereof for lockable positioning within said opening so as to prevent the evaporation of the liquid fuel in said container.

9. An apparatus as recited in claim 8 wherein said container is of an integral, seamless steel construction and includes a corrosive-proof exterior coating.

10. An apparatus as recited in claim 1 further including a plastic or like material container lid structured and disposed to be fitted atop said top of said container in generally sealed, covering relation thereon.

* * * * *